United States Patent [19]

Lindberg

[11] Patent Number: 4,694,616

[45] Date of Patent: Sep. 22, 1987

[54] REMOVABLE BELT-BACKING MECHANISM FOR A BELT SANDER

[76] Inventor: Robert C. Lindberg, Rte. 2, Box 306R, Dorchester, Wis. 54425

[21] Appl. No.: 878,415

[22] Filed: Jun. 25, 1986

[51] Int. Cl.[4] ..... B24B 23/06

[52] U.S. Cl. ..... 51/170 EB

[58] Field of Search ..... 51/170 R, 170 EB, 135 R, 51/135 BT

[56] References Cited

U.S. PATENT DOCUMENTS

| | | | |
|---|---|---|---|
| 2,106,535 | 1/1938 | Pattison et al. . | |
| 2,483,720 | 10/1949 | Asbury . | |
| 2,486,255 | 10/1949 | Briskin . | |
| 2,538,044 | 1/1951 | Ruehle . | |
| 2,556,041 | 6/1951 | Pick . | |
| 2,819,565 | 1/1958 | Werth . | |
| 2,976,652 | 3/1961 | Bedortha et al. . | |
| 3,009,297 | 11/1961 | Westerfield . | |
| 3,073,083 | 1/1963 | Reichert . | |
| 3,091,061 | 5/1963 | Bahr . | |
| 3,334,447 | 8/1967 | Leveque | 51/170 EB |
| 3,465,479 | 9/1969 | Foody et al. . | |
| 3,496,679 | 2/1970 | Dunn | 51/170 EB |
| 3,497,336 | 2/1970 | Buschman . | |
| 3,566,549 | 3/1971 | Britton . | |
| 3,983,664 | 8/1976 | Martin | 51/170 EB |
| 4,043,083 | 8/1977 | Rosdil | 51/170 EB |
| 4,118,897 | 10/1978 | Martin | 51/170 EB |
| 4,317,282 | 3/1982 | Pace | 30/122 |
| 4,334,390 | 6/1982 | Sumerau | 51/170 EB |
| 4,510,718 | 4/1985 | Eichenlaub | 51/170 EB |
| 4,587,770 | 5/1986 | Lindberg | 51/170 EB |

FOREIGN PATENT DOCUMENTS

| | | | |
|---|---|---|---|
| 172967 | 11/1952 | Fed. Rep. of Germany | 51/170 EB |
| 539092 | 2/1956 | Italy | 51/170 EB |

*Primary Examiner*—Roscoe V. Parker

*Attorney, Agent, or Firm*—Andrus, Sceales, Starke & Sawall

[57] ABSTRACT

A removable belt-backing mechanism (50) is provided for a hand-held endless loop belt sander (2). The belt-backing mechanism (50) includes an attachment bracket (52), which slidably cooperates with a pair of slots (66, 68) to provide a removable connection to the sander. A plate (70) is movably connected to the attachment bracket (52) by a set of pins (72, 74, 76, 78), and is biased toward the inside surface of the sanding belt (26) by a set of springs (96, 98) to provide a flat sanding area for sanding planar surfaces.

21 Claims, 2 Drawing Figures

REMOVABLE BELT-BACKING MECHANISM FOR A BELT SANDER

BACKGROUND AND SUMMARY

The invention relates to a removable mechanism for attachment to a hand-held endless loop belt sander. More particularly, the invention relates to a removable mechanism for providing a substantially flat sanding area when pressure is applied to the sanding belt between rollers. The object of the invention is to provide a removable mechanism which allows an endless loop belt sander to be used for sanding both planar and non-planar surfaces, for example in automotive repair work. The invention is useful in numerous other applications, but is particularly useful when it is desired to sand both planar and non-planar surfaces with the same belt sander.

The removable mechanism of the present invention includes a belt-backing plate biased toward the inside surface of the sanding belt. The belt-backing plate is movably connected to a slidable attachment structure, which facilitates easy attachment to and removal from a belt sander. Bias means are provided between the attachment structure and the belt-backing plate to urge the plate toward the inside surface of the belt.

DESCRIPTION OF THE INVENTION

Figures 1, 2:
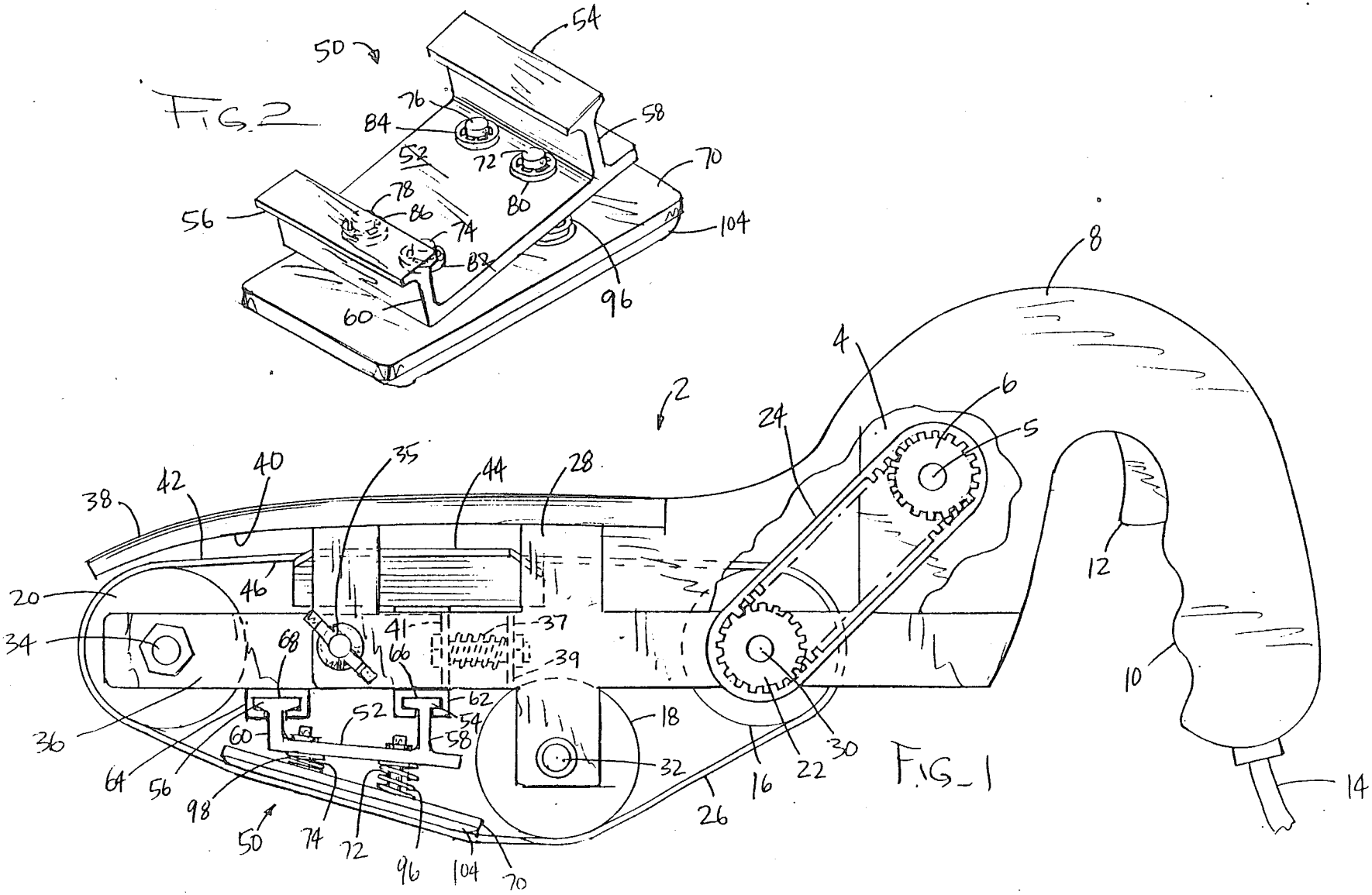
FIG. 1 is an elevation view of a motorized hand-held belt sander incorporating the removable belt-backing mechanism of the present invention, with a portion broken away.
FIG. 2 is a perspective view of the removable belt-backing mechanism shown in FIG. 1.

FIG. 1 shows a portable hand-held endless loop belt sander 2 similar to that shown in my U.S. Pat. No. 4,587,770, issued May 13, 1986, hereby incorporated herein by reference. Sander 2 is provided with a motor 4 mounted in a housing 8, which is molded to provide a handle 10. Electrical power is suppled to motor 4 via a power cord 14. A manually actuable trigger 12 is mounted in housing 8, and is engageable by the user's finger to regulate the supply of electrical power to motor 4.

A motor drive gear 6 is mounted on and engaged by a shaft 5. Shaft 5 is rotatably driven by motor 4, thereby imparting rotation to motor drive gear 6. Motor drive gear 6 engages a grooved drive belt 24, which is also engaged by a roller drive gear 22. Roller drive gear 22 is mounted on and engaged by an axle 30, which has a drive roller 16 mounted thereon. Rotation imparted to motor drive gear 6 by motor 4 is transferred to drive roller 16 through grooved drive belt 24, roller drive gear 22, and axle 30. To insure safety, a guard plate (not shown) encloses drive gears 6 and 22 and belt 24.

Belt sander 2 has a pair of opposed frame members 28, with a cross member 39 extending therebetween. Construction and assembly of opposed frame members 28 is shown in detail in FIG. 4 of my U.S. Pat. No. 4,587,770, showing frame members 6*a*, 6*b* and 6*c*. Housing 8 abuts frame members 28, with the sides of housing 8 being aligned with the sides of frame members 28. Axles 30 and 32 extend between frame members 28, and are rotatably mounted thereto. Drive roller 16 is mounted on axle 30, and a first idle roller 18 is mounted on axle 32.

A U-shaped carriage 36 is movably mounted to frame members 28 for left-right movement. Carriage 36 has a second idle roller 20 rotatably mounted thereto by means of an axle 34 extending between the facing sides of carriage 36. A wing nut assembly 35 is provided to secure carriage 36 against movement relative to frame members 28 during operation, as shown in my U.S. Pat. No. 4,587,770. Locking means 78 in FIG. 4 of my U.S. Pat. No. 4,587,770 may be modified by flattening latch 80 and replacing aperture 84, shown in FIG. 2 of the noted patent, with an inwardly extending boss for engaging the forward edge of protrusion 82 upon rearward retraction of the carriage. In this manner, the carriage is retained in a rearwardly retracted position relative to the frame, against the bias of the spring, to permit changing or replacement of the belt.

Rollers 16, 18, and 20 are hard rubber wheels which may be scored or knurled for frictional gripping. The rollers form a triangular configuration for receiving an endless loop sanding belt 26 therearound.

Belt 26 is tensioned by way of a biasing means 37 bearing between facing cross members 39 and 41 of the frame and carriage, respectively. Carriage 36 is biased rectilinearly leftwardly away from frame 28 to tension belt 26. Biasing means 37 is a compression spring lying along the rectilinearly biased path of movement of carriage 36 in the straight line between drive roller 16 and second idle roller 20.

A combined guard plate and pressure guide 38 is mounted on frame 28, as shown in FIG. 3 of my U.S. Pat. No. 4,587,770, referenced at 54 and 58. Guard plate and pressure guide 38 abuts housing 8, and has an inner surface 40 facing an outer surface 42 of belt 26 and is spaced outwardly from and above belt 26. Guard plate and pressure guide 38, in combination with housing 8, serves to shield outer surface 42 of belt 26 along the straight line between drive roller 16 and second idle roller 20. Guard plate and pressure guide 38 is engageable by a user's hand or the like for guidance and application of downward pressure against a surface to be sanded, for example between rollers 18 and 20 or between rollers 16 and 18.

A belt tracking tray 44 is mounted on carriage 36. Tray 44 engages the inner non-sanding surface 46 of belt 26 for guiding the movement of belt 26, to insure tracking engagement with rollers 16, 18, and 20. Tracking tray 44 is a V-shaped member engaging the edges of belt 26, slightly bowing the middle of belt 26 downwardly toward the apex of tracking tray 44. For the frame assembly described thus far, further reference may be had to my above noted U.S. Pat. No. 4,587,770.

The present invention incorporates a removable belt-backing mechanism 50. Removable belt-backing mechanism 50 includes a substantially U-shaped bracket 52 having enlarged portions 54 and 56 provided at the top of upstanding legs 58 and 60, respectively. A pair of C-shaped channel members 62 and 64 are mounted on carriage 36 between idle rollers 18 and 20, such as by welding or the like. Channel members 62 and 64 extend the entire width of carriage 36 perpendicularly to the direction in which carriage 36 is biased by biasing means 37. Channel members 62 and 64 are provided with slots 66 and 68 extending throughout the length of channel members 62 and 64. Belt-backing mechanism 50 is attached to and removed from sander 2 by slidable cooperation of enlarged portions 54 and 56 with slots 66 and 68, as will be explained.

Belt-backing mechanism 50 is provided with a backing plate 70, disposed parallel to belt 26 spanning between idle rollers 18 and 20. Plate 70 is disposed at an angle relative to the base of bracket 52, the angle opening toward idle roller 18. Plate 70 is centrally located within the sanding span between rollers 18 and 20, and extends more than half the length of said span. In this manner, the flat sanding area provided in the sanding span between rollers 18 and 20 for sanding planar surfaces is maximized, while the portion of said span available for inward flexing is kept to a minimum. Plate 70 is substantially the same width as belt 26, to ensure maximum utilization of available sanding area and even wearing of belt 26.

Plate 70 is movably connected to bracket 52 by pins 72, 74, 76, and 78. Pins 72, 74, 76, and 78 are mounted on plate 70 such as by welding or the like, and are connected to bracket 52 through a set of holes provided in bracket 52. Each pin is provided with an annular groove at its top (not shown). Pins 72, 74, 76 and 78 are inserted through the set of holes provided in bracket 52, and lock washers 80, 82, 84, and 86 are secured to the annular grooves in the pins to prevent the pins from disengaging bracket 52 and to provide a movable connection of plate 70 to bracket 52.

The pins are arranged so that pins 72 and 76 are adjacent idle roller 18, and pins 74 and 78 are adjacent idle roller 20. Because of the angle between plate 70 and bracket 52, pins 72 and 76 extend a greater distance than do pins 74 and 78.

Belt-backing mechanism 50 has a compression spring provided around each of pins 72, 74, 76, and 78, bearing between bracket 52 and plate 70 for biasing plate 70 away from bracket 52 and toward inside surface 46 of belt 26. Only springs 96 and 98, provided at pins 72 and 74, are shown in FIG. 1.

Plate 70 is provided with a layer of resilient material 104. Resilient layer 104 may be made of a material such as rubber, in order to reduce wear on belt 26.

In operation, the user removes belt-backing mechanism 50 to sand non-planar surfaces. Removal of belt-backing mechanism 50 is accomplished by slidably disengaging enlarged portions 54 and 56 from slots 66 and 68 in a direction out of the page, as shown in FIG. 1. In this manner, belt-backing mechanism 50 can be removed from sander 2 without removal of belt 26. When belt-backing mechanism 50 is removed, the sanding span between rollers 18 and 20 flexes inwardly when pressure is applied thereto for sanding a curved surface.

To sand planar surfaces, the user attaches belt-backing mechanism 50 by slidably engaging enlarged portions 54 and 56 with slots 66 and 68. Again, attachment of belt-backing mechanism 50 can be accomplished while belt 26 remains in place. With belt-backing mechanism 50 attached, the user can sand planar surfaces by application of pressure to the sanding span between rollers 18 and 20. Plate 70 and resilient layer 104 resist the inward flexing of the sanding span when pressure is so applied. The springs provided between plate 70 and bracket 52 allow a slight amount of inward movement of belt 26 to accommodate the application of pressure, while maintaining a flat sanding span.

It is recognized that various alternatives are possible within the scope of the appended claims, particularly pointing out and distinctly claiming the subject matter regarded as the invention.

I claim:

1. A removable belt-backing mechanism for attachment to a belt sander having at least two rollers and an endless loop sanding belt therearound for forming a sanding span therebetween, said belt having an outer sanding surface and an inner surface engaged by said rollers, said belt sander being provided with belt tensioning means for performing the dual function of maintaining tension in said belt both when said belt-backing mechanism is attached to said sander and when said belt-backing mechanism is removed from said sander, so that the same belt can be used on said sander for sanding flat surfaces when said belt-backing mechanism is in place on said sander and for sanding curved surfaces when said belt-backing mechanism is removed from said sander, said removable belt-backing mechansim comprising:

attachment means for removable mounting of said belt-backing mechanism on said sander within said loop of said belt, said attachment means including a bearing surface spaced away from the connection of said attachment means to said sander and toward said belt, said attachment means being adapted for removable interconnection with a receiving means provided on said sander;

plate means having a substantially flat surface movably connected to said attachment means; and biasing means bearing between said bearing surface of said attachment means and said plate means for biasing said plate means away from said attachment means and toward the inner surface of said belt, so that a substantially flat sanding area is maintained along the portion of said sanding span-backed by said plate means when pressure is applied to said sanding span.

2. The invention according to claim 1, wherein said attachment means comprises a substantially U-shaped bracket member having a pair of upstanding legs with a transverse base portion therebetween connected to said upstanding legs, and wherein said bearing surface spaced away from the connection of said attachment means to said sander comprises said base portion of said U-shaped bracket member and said receiving means comprises a pair of slots provided on said sander, each of said upstanding legs of said U-shaped bracket member having an enlarged portion at its top for mating with said pair of slots and providing slidable engagement therewith.

3. The invention accordding to claim 1, wherein said biasing means comrpises, compression spring means bearing between said leaving surface of said attachment means and said plate means for biasaing said plate means away from said attachment means and toward the inner surface of said belt.

4. The invention according to claim 1, further comprising a layer of resilient material disposed on said plate means and facing the inner surface of said belt.

5. The invention according to claim 4, wherein said layer of resilient material is composed of rubber.

6. The invention according to claim 1, wherein said belt-backing mechanism is removable as unit from said sander by the disengagement of said belt-backing mechanism from said receiving means, with said biasing means remaining actively intact on said belt-backing mechanism during said disengagement form said sander.

7. A removable belt-backing mechanism for attachment to a belt sander having at least two rollers and an endless loop sanding belt therearound for forming a sanding span therebetween, said belt having an outer sanding surface and an inner surface engaged by said rollers, said belt sander being provided with belt tensioning means for performing the dual function of maintaining tension in said belt both when said belt-backing mechanism is attached to said sander and when said belt-backing mechanism is removed from said sander, so that the same belt can be used on said sander for sanding flat surfaces when said belt-backing mechanism is in place on said sander and for sanding curved surfaces when said belt-backing mechanism is removed from said sander, said removable belt-backing mechanism comprising:

attachment means for removable mounting of said belt-backing mechanism on said sander within said loop of said belt, said attachment means comprising a substantially U-shaped bracket member having a pair of upstanding legs and a transverse base portion therebetween spaced away from said sander toward said belt and connected to said upstanding legs, said upstanding legs of said U-shaped bracket member each having an enlarged portion provided at its top for slidable engagement of said enlarged portions with a pair of slots provided on said sander;

a backing plate movably mounted to said base portion of said U-shaped bracket member; and compression spring means bearing between said base portion of said U-shaped bracket member and said backing plate for biasing said backing plate away from said U-shaped bracket member and toward the inside surface of said belt so that a substantially flat sanding area is maintained along the portion of said sanding span backed by said backing plate when pressure is applied to said sanding span, said belt-backing mechanism being removable as a unit from said sander, with said biasing means remaining actively intact on said belt-backing mechanism during disengagement from said sander.

8. A belt sander, comprising:

a drive roller;

at least one idle roller;

an endless loop sanding belt around said drive and idle rollers to form a sanding span therebetween, said belt having an outer sanding surface and an inner surface engaged by said rollers;

a removable belt-backing mechanism, comprising:

attachment means for removable mounting of said belt-backing mechanism on said sander within said loop of said belt, said attachment means including a bearing surface spaced away from the connection of said attachment means to said sander and toward said belt, said attachment means being adapted for removable interconnection with a receiving means provided on said sander;

plate means having a substantially flat surface movably connected to said attachment means; and biasing means bearing between said bearing surface and said plate means for biasing said plate means away from said attachment means and toward the inner surface of said belt, so that a substantially flat sanding area is maintained along the portion of said sanding span backed by said plate means when pressure is applied to said sanding span; and belt tensioning means for performing the dual function of maintaining tension in said belt both when said belt-backing mechanism is attached to said sander and when said belt-backing mechanism is removed from said sander, so that the same belt can be used on said sander for sanding flat surfaces when said belt-backing mechanism is in place on said sander and for sanding curved surfaces when said belt-backing mechanism is removed from said sander.

9. The invention according to claim 8, wherein said attachment means comprises a substantially U-shaped bracket member having a pair of upstanding legs and a transverse base portion therebetween connected to said upstanding legs, and wherein said bearing surface spaced away from the connection of said attachment means to said sander comprises said base portion of said U-shaped bracket member and said receiving means comprises a pair of slots provided on said sander, each of said upstanding legs having an enlarged portion at its top for mating with said pair of slots and providing slidable engagement therewith.

10. The invention according to claim 8, wherein said belt-backing mechanism is removable as a unit from said sander by the disengagement of said belt-backing mechanism from said receiving means, with said biasing means remaining actively intact on said belt-backing mechanism during said disengagement from said sander

11. A belt sander, comprising:

a drive roller;

at least one idle roller;

an endless loop sanding belt around said drive and idle rollers to form a sanding span therebetween, said belt having an outer sanding surface and an inner surface engaged by said rollers;

a removable belt-backing mechanism, comprising:

attachment means removably mounted on said sander within said loop of said belt, said attachment means comprising a substantially U-shaped bracket member having a pair of upstanding legs and a transverse base portion therebetween connected to said upstanding legs and spaced away from the connection of said U-shaped bracket to said sander and toward said belt, said upstanding legs of said U-shaped bracket member each having an enlarged portion provided at its top for slidable engagement with a pair of slots provided on said sander;

a backing plate movably mounted to the base portion of said U-shaped bracket member; and compression spring means bearing between the base portion of said U-shaped bracket member and said backing plate for biasing said backing plate away from said U-shaped bracket member and toward the inner surface of said belt, so that a substantially flat sanding area is maintained along at least the portion of said sanding span backed by said backing plate, said belt-backing mechanism being removable as a unit from said sander, with said biasing means remaining actively intact on said belt-backing mechanism during disengagement from said sander; and belt tensioning means for maintaining tension in said belt both when said belt-backing mechanism is attached to said sander and when said belt-backing mechanism is removed from said sander, so that the same belt can be used on said sander for sanding flat surfaces when said belt-backing mechanism is in place on said sander and for sanding curved surfaces when said belt-backing mechanism is removed from said sander.

12. A belt sander comprising:
a frame;
a drive roller rotatably mounted to said frame;
a first idle roller rotatably mounted to said frame;
a carriage movably mounted to said frame;
a second idle roller rotatably mounted to said carriage, said rollers forming a triangular configuration for receiving an endless loop sanding belt therearound, said rollers being interior of said sanding belt;
belt tensioning means comprising biasing means bearing between said frame and carriage and biasing said carriage rectilinearly away from said frame to tension said belt, said sanding belt having a flexible span between at least two of said rollers, providing a sanding belt which flexes inwardly such that its outer surface curves when applied against curved non-planar sanding surfaces;
wherein said biasing means comprises compression spring means lying along the rectilinearly biased path of movement of said carriage, and wherein said sanding belt has a first flexible sanding span between said first idle roller and said second idle roller, and a second flexible sanding span between said first idle roller and said drive roller;
wherein said carriage and said second idle roller are biased along a straight line between said drive roller and said second idle roller, and said compression spring means lies along said straight line;
a combined guard plate and pressure guide mounted to said frame and having an inner surface facing said outer surface of said belt and spaced outwardly away therefrom and having an outer surface engagable by a user's hand or the like for guidance and application of pressure, said combined guard plate and pressure guide being for the application of sanding pressure to each of said spans against respective sanding surfaces; and
a removable belt-backing mechanism, comprising:
attachment means for removable mounting of said belt-backing mechanism on said sander within said loop of said belt and adjacent to said first flexible sanding span;
plate means having a substantially flat surface movably mounted to said attachment means; and
biasing means bearing between said attachment means and said plate means for biasing said plate means away from said attachment means and toward the inner surface of said belt, so that a substantially flat sanding area is maintained along the portion of said first sanding span backed by said plate means when pressure is applied to said first sanding span.

13. The invention according to claim 12, wherein said attachment means of said removable belt-backing mechanism comprises a substantially U-shaped bracket member having a pair of upstanding legs and having an enlarged portion at the top of each of said upstanding legs for slidable engagement with a pair of slots provided on said sander.

14. The invention according to claim 13, wherein said slots provided on said sander are provided by a pair of substantially C-shaped channel members mounted on said sander between said first and second idle rollers, said channel members extending perpendicularly to the direction in which said carriage is biased.

15. The invention according to claim 14, wherein said C-shaped channel members are mounted on said carriage and extend the entire width of said carriage.

16. The invention according to claim 15, wherein said plate means of said removable belt-backing mechanism is disposed parallel to said belt spanning said first flexible sanding span, and is disposed at an angle to said U-shaped bracket member, said angle opening toward said first idle roller.

17. The invention according to claim 16 wherein said plate means of said removable belt-backing mechanism is movably mounted to said U-shaped bracket by a plurality of upstanding pins connected to said plate means and inserted through a plurality of holes provided in said U-shaped bracket, said plurality of holes allowing said plurality of pins to pass through said bracket, and said pins being provided at their tops with means for preventing disengagement of said pins from said bracket after said pins are inserted through said holes.

18. The invention according to claim 17, wherein said biasing means of said removable belt-backing mechanism comprises compression spring means provided around each of said pins.

19. The invention according to claim 18, wherein said pins are arranged so that at least one of said pins is adjacent to said first idle roller and at least one of said pins is adjacent said second idle roller.

20. The invention according to claim 19, wherein said pin adjacent said first idle roller extends a greater distance between said plate and said U-shaped bracket member than said pin adjacent said second idle roller.

21. A belt sander comprising:
a frame;
a drive roller rotatably mounted to said frame;
a first idle roller rotatably mounted to said frame;
a carriage movably mounted to said frame;
a second idle roller rotatably mounted to said carriage, said rollers forming a triangular configuration for receiving an endless loop sanding belt therearound, said rollers being interior of said sanding belt;
belt tensioning means comprising biasing means bearing between said frame and carriage and biasing said carriage rectilinearly away from said frame to tension said belt, said sanding belt having a flexible span between at least two of said rollers, providing a sanding belt which flexes inwardly such that its outer surface curves when applied against curved non-planar sanding surfaces;
wherein said biasing means comprises compression spring means lying along the rectilinearly biased path of movement of said carriage, and wherein said sanding belt has a first flexible sanding span between said first idle roller and said second idle roller, and a second flexible sanding span between said first idle roller and said drive roller;
wherein said carriage and said second idle roller are biased along a straight line between said drive roller and said second idle roller, and said compression spring means lies along said straight line;
a combined guard plate and pressure guide mounted to said frame and extending around an edge of said belt and having an inner surface facing said outer surface of said belt and spaced outwardly away therefrom and having an outer surface engageable by a user's hand or the like for guidance and application of pressure, said combined guard plate and pressure guide applying sanding pressure to each of said spans against respective sanding surfaces; and a removable belt-backing mechanism, comprising:

attachment means removably mounted on said sander within said loop of said belt and adjacent said first flexible sanding span, said attachment means comprising a substantially U-shaped bracket member having a pair of upstanding legs and having an enlarged portion provided at the top of each upstanding legs for slidable engagement with a pair of substantially C-shaped channel members mounted on said carriage and extending the entire width of said carriage perpendicularly to the direction in which said carriage is biased;

a backing plate having substantially the same width as said sanding belt movably mounted to said U-shaped bracket member and disposed parallel to said belt spanning said first flexible sanding span and at an angle to said U-shaped bracket member, said angle opening toward said first idle roller, said backing plate extending more than half the length of said first sanding span and being substantially centrally located within said first sanding span;

wherein said backing plate is movably mounted to said U-shaped bracket member by a plurality of upstanding pins connected to said backing plate and inserted through a plurality of holes provided in said U-shaped bracket, said plurality of holes allowing said plurality of pins to pass through said bracket, said pins being provided at their tops with means for preventing disengagement of said pins from said bracket after said pins are inserted through said holes, said pins being arranged so that at least one pin is adjacent to said first idle roller and at least one pin is adjacent said second idle roller, and said pin adjacent said first idle roller extends a greater distance between said plate and said bracket member than said pin adjacent said second idle roller;

a layer of resilient material disposed on said backing plate and facing the inside surface of said belt; and compression spring means provided at each of said pins bearing between said U-shaped bracket member and said backing plate for biasing said backing plate away from said U-shaped bracket member and toward the inner surface of said belt, so that a substantially flat sanding area is maintained along at least the portion of said sanding span backed by said backing plate when pressure is applied to said sanding span.

* * * * *

UNITED STATES PATENT AND TRADEMARK OFFICE

CERTIFICATE OF CORRECTION

PATENT NO. : 4,694,616

DATED : 9-22-87

INVENTOR(S) : Robert C. Lindberg

It is certified that error appears in the above-identified patent and that said Letters Patent is hereby corrected as shown below:

Col. 1, line 42, Delete "suppled" and substitute therefor ---supplied---; Claim 1, col. 4, line 32, Delete "span-backed" and substitute therefor ---span backed---; Claim 3, col. 4, line 48, Delete "accordding" and substitute therefor ---according---; Claim 3, col. 4, line 49, Delete "comrpises," and substitute therefor ---comprises---; Claim 3, col. 4, line 50, Delete "leaving" and substitute therefor ---bearing---; Claim 3, col. 4, line 51, Delete "biasaing" and substitute therefor ---biasing---; Claim 6, col. 4, line 60, After "as" insert ---a---; Claim 6, col. 4, line 64, Delete "form" and substitute therefor ---from---; Claim 7, col. 5, line 31, After "belt" insert ---,---; Claim 8, col. 5, line 57, Cancel "and"; Claim 10, col. 6, line 25, After "sander" insert

UNITED STATES PATENT AND TRADEMARK OFFICE

CERTIFICATE OF CORRECTION

PATENT NO. : 4,694,616

DATED : 9-22-87

INVENTOR(S) : Robert C. Lindberg

It is certified that error appears in the above-identified patent and that said Letters Patent is hereby corrected as shown below:

---.---; Claim 11, col. 6, line 47, Cancel "and"; Claim 12, col. 7, line 35, Delete "engagable" and substitute therefor ---engageable---; Claim 17, col. 8, line 10, After "16" insert ---,---

Signed and Sealed this

Twenty-second Day of March, 1988

*Attest:*

*Attesting Officer*

DONALD J. QUIGG

*Commissioner of Patents and Trademarks*